United States Patent [19]

Gallusser et al.

[11] Patent Number: 4,527,851

[45] Date of Patent: Jul. 9, 1985

[54] ELECTRICAL CONNECTOR ASSEMBLY HAVING AN INTERFACIAL SEAL

[75] Inventors: David O. Gallusser, Oneonta; David L. Frear, Bainbridge, both of N.Y.

[73] Assignee: Allied Corporation, Morristown, N.J.

[21] Appl. No.: 610,068

[22] Filed: May 14, 1984

[51] Int. Cl.[3] ..... H01R 4/00

[52] U.S. Cl. ..... 339/94 M; 339/217 S

[58] Field of Search ..... 339/94, 59–61

[56] References Cited

U.S. PATENT DOCUMENTS

| | | | |
|---|---|---|---|
| 2,419,018 | 4/1947 | Gudie | 173/328 |
| 2,567,727 | 9/1951 | Quackenbush | 339/94 R |
| 2,704,355 | 3/1955 | Holton | 339/94 A |
| 3,109,690 | 11/1963 | Stevens, Jr. | 339/60 |
| 3,210,720 | 10/1965 | Harris | 339/149 |
| 3,328,746 | 6/1967 | Schumacher | 339/94 |
| 3,394,339 | 7/1968 | Gaskievicz et al. | 339/176 |
| 3,571,779 | 3/1971 | Collier | 339/94 M |
| 3,576,517 | 4/1971 | Johnson | 339/94 R |
| 3,638,165 | 1/1972 | Anhalt et al. | 339/59 R |
| 3,678,441 | 7/1972 | Upstone et al. | 339/94 R |
| 3,721,943 | 3/1973 | Curr | 339/94 M |
| 3,727,172 | 4/1973 | Clark | 339/59 M |
| 3,970,352 | 7/1976 | Dorrell et al. | 339/94 M |
| 4,084,875 | 4/1978 | Yamamoto | 339/94 M |
| 4,116,521 | 9/1978 | Herrmann, Jr. | 339/94 C |
| 4,133,593 | 1/1979 | Moulin | 339/94 R |
| 4,437,719 | 3/1984 | Miyamoto | 339/94 R |

*Primary Examiner*—Gil Weidenfeld
*Assistant Examiner*—David L. Pirlot
*Attorney, Agent, or Firm*—C. D. Lacina

[57] ABSTRACT

An interfacial seal for electrical connector assembly characterized by sealing towers (21) on a first insert (10) that are axially compressed and radially expanded by the forward end (43) of respective socket contacts in a second insert (20) so that the walls of each tower (21) are in pressure tight contact with the wall (32) of respective passages (33) in the second insert (30).

1 Claim, 4 Drawing Figures

ELECTRICAL CONNECTOR ASSEMBLY HAVING AN INTERFACIAL SEAL

This invention relates to an electrical connector assembly and more particularly to an environmental seal at the interface between the inserts of the connector assembly.

An electrical connector assembly generally includes two housings such as a plug and a receptacle connected together by a coupling ring. Mounted in each housing is an insert of dielectric material provided with multiple openings within which electrical contacts are releasably retained. In many applications, an interfacial sealing member is located between the mating faces of the inserts of the connector assembly. The interfacial seal isolates each electrical contact from the detrimental effects of otherwise degrading environments such as moisture, sand, dust, fluids and fumes and prevents these environments from being transmitted from one piece of equipment to another area through the connector. Examples of interfacial seals in electrical connector assemblies may be found in U.S. Pat. Nos. 3,678,441 entitled "Electrical Connector Interfacial Seals" issued July 18, 1972; 3,721,943 entitled "Electrical Connecting Device," issued Mar. 20, 1973; and 3,727,172 entitled "Electrical Connector," issued Apr. 10, 1973.

Recently, electrical connector insert assemblies have been made by molding the insert assembly as a single integral piece. Accordingly, the insert assembly would include an integral contact retaining mechanism such as resiliently deflectable fingers. In such an approach, the mold for making such an insert does not permit tapered openings. Therefore, the interfacial seal is designed as a cylindrical passage in one insert with a complementary cylindrical sealing member extending from the other insert that fits into the cylindrical passage. Such an arrangement and the arrangements shown in the prior art patents, do not provide for a pressure tight fit within the passage of the insert. Tapering the cylindrical portion may help to increase the pressure between the sealing elements but it has the disadvantages of distorting one of the insert faces and substantially increasing the force required to couple the connector housings together. None of the foregoing patents or approaches provide for a pressure tight seal being formed by expansion of a sealing member within the passage of a connector insert.

DISCLOSURE OF THE INVENTION

This invention is an electrical connector assembly having an interfacial seal that is characterized by a plurality of resilient towers extending from the front face of one of the inserts into respective passages of the other insert, the towers being axially compressed and distorted radially outwardly by respective socket contacts in the other insert so that the outside surface of each tower is in pressure tight relationship with a respective wall of a passage in the other insert.

Accordingly, it is an advantage of this invention to provide an electrical connector assembly that has an improved interfacial seal.

DETAILED DESCRIPTION OF THE INVENTION

Figure 1:
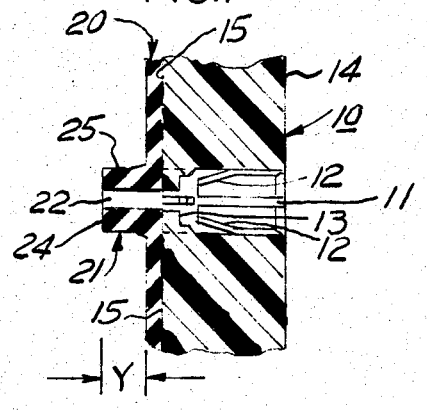
FIG. 1 is a partial view of an insert and interfacial seal for a connector assembly.

Referring now to the drawings, FIG. 1 illustrates a portion of an insert 10 and an interfacial sealing member 20 of an electrical connector assembly. The insert 10 includes a rear face 14, a forward face 15, and a plurality of passages 11. Each of the passages 11 includes a means for releasably retaining an electrical contact (not shown) that includes a plurality of resiliently deflectable fingers 12, and a shoulder 13. The shoulder 13 and deflectable fingers 12 are used to captivate an enlarged portion of the electrical contact so that it is releasably retained in the connector insert 10. Bonded to the front face 15 of the insert 10 is an interfacial sealing member 20 which includes a plurality of forwardly extending towers 21, each tower having a passage 22 therein axially aligned with the passage 11 in the insert 10, a forward face 24 and an outer surface or wall 25. The interfacial seal is generally comprised of a resilient material such as rubber so that a force acting on the front face 24 of a tower 21 will axially compress and radially distort the tower 21. Each of the towers 21 extends a distance Y from the front face of the interfacial sealing member 20.

Figure 2:
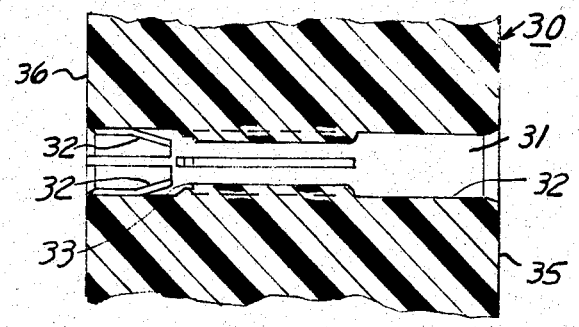
FIG. 2 is a partial view of an insert for the other half of a connector assembly.

FIG. 2 illustrates the configuration of a passage 31 of a second and complementary insert 30 in the other half of the electrical connector assembly. The second insert 30 includes a front face 35, rear face 36, a plurality of axial passages 31 adapted to retain contacts and be aligned with the passages 11 and the other insert 10, and similar resiliently deflectable contact retaining fingers 32 and shoulder 33.

Figure 3:
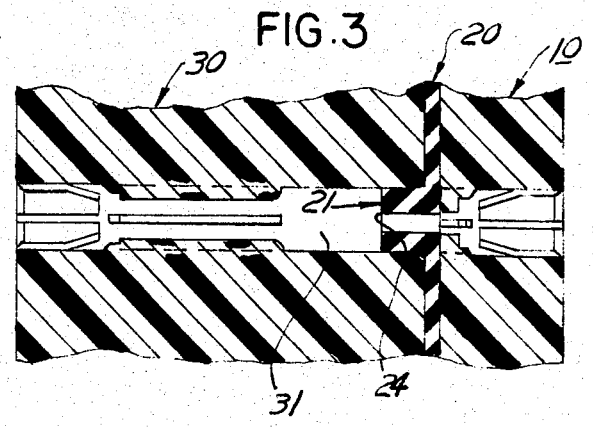
FIG. 3 illustrates the inserts of electrical connector assembly with an interfacial seal between the two inserts.

FIG. 3 illustrates the first insert 10, the second insert 30, and the interfacial seal 20 when the tower 21 of the interfacial sealing member 20 is located in the passage 31 of the second insert 30.

Figure 4:
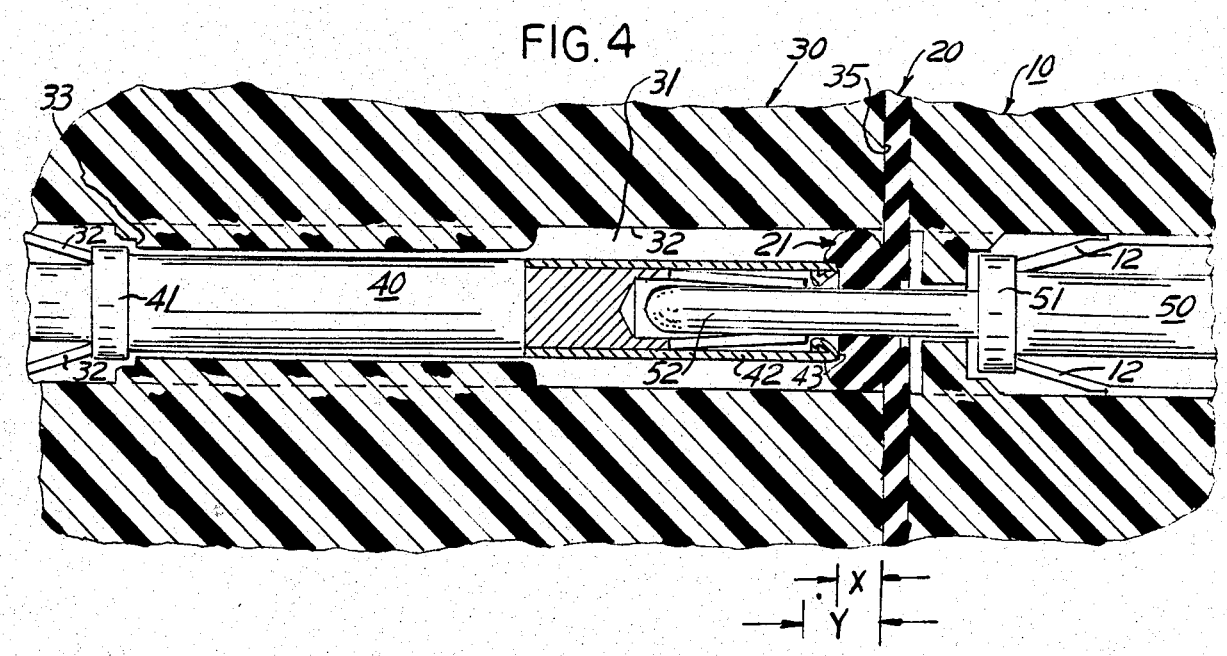
FIG. 4 illustrates a partial cut away view of an electrical connector assembly incorporating the principles of this invention.

FIG. 4 shows the functional interrelationship between the interfacial sealing member 20 and the contacts 40, 50 mounted in respective inserts 10 and 30. A pin type electrical contact 50 is releasably retained in the first insert 10 by having the enlarged portion 51 of the contact captivated by the contact retaining fingers 12 and shoulder 13. Similarly, a socket type electrical contact 40 is releasably retained in the second insert 30 by having the enlarged portion 41 thereof captivated between the deflectable fingers 32 and shoulder 33.

When the two halves of this electrical connector assembly are coupled together, the mating portion 52 of the pin type contact 50 mates with the mating portion 42 of the socket type contact 40. The forward end surface 43 of each socket contact 40 engages the forward end 24 of a respective tower 21 of the interfacial sealing member 20 and axially compresses and radially expands each tower 21 so that it is in pressure tight contact with the wall 32 of a respective passage 31 in the second insert 30. This compression and expansion of the tower 21 within the passage 31 provides an improved interfacial seal.

Having described the invention what is claimed is:

1. In combination with an electrical connector assembly having an interfacial seal, said connector assembly of the type having a first insert having at least one passage extending from a forward face to a face of said insert; at least one electrical pin type contact; means for mounting each pin contact in a respective passage so that a forward mating portion of the pin contact extends from the forward face of said first insert; a second insert having at least one passage therein extending from a front face to a rear face of said second insert; at least one socket type electrical contact; means for mounting each socket type contact in a respective passage in said second insert so that the end of a forward mating portion of the socket contact terminates within said passage in said second insert at a predetermined distance X from the front face of the second insert; and an interfacial sealing member comprised of a resilient material and having at least one passage therethrough, said interfacial sealing member mounted to the forward face of the first insert with each passage through said sealing member aligned with a respective passage in the first insert, said sealing member including a forwardly extending tower around each passage in said seal and extending around a portion of the mating portion of a respective pin type contact, the improvement wherein the interfacial seal is characterized by:

each of said towers having a configuration slightly smaller than the configuration of the passage in said second insert, said tower extending forwardly in its uncompressed state a distance Y which is greater than the distance X that the end of each socket contact terminates from the front face of said second insert, each of said pin type contacts mates with a respective socket type contact, each of the towers is located in a respective passage in the second insert and the forward end of each socket contact is engaged with a forward end of a respective tower, axially compressing and distorting each tower radially outwardly to cause outside walls of said tower to be in pressure tight relationship with the wall of the respective passage in the second insert.

* * * * *